US008820980B2

(12) United States Patent
Frank

(10) Patent No.: US 8,820,980 B2
(45) Date of Patent: Sep. 2, 2014

(54) DISPLAY APPARATUS, ELECTRICAL APPLIANCE AND DISPLAY METHOD

(71) Applicant: E.G.O. Electro-Gerätebau GmbH, Oberderdingen (DE)

(72) Inventor: Marcus Frank, Sulzfeld (DE)

(73) Assignee: E.G.O. Elektro-Gerätebau GmbH, Oberderdingen (DE)

( * ) Notice: Subject to any disclaimer, the term of this patent is extended or adjusted under 35 U.S.C. 154(b) by 124 days.

(21) Appl. No.: 13/630,762

(22) Filed: Sep. 28, 2012

(65) Prior Publication Data

US 2013/0083519 A1 Apr. 4, 2013

(30) Foreign Application Priority Data

Sep. 28, 2011 (DE) ..... 10 2011 114 741

(51) Int. Cl.
*F21V 13/00* (2006.01)
*G09F 23/00* (2006.01)

(52) U.S. Cl.
CPC ..... *F21V 13/00* (2013.01); *G09F 23/0058* (2013.01)
USPC ..... 362/311.02; 362/235; 362/231; 362/97.1; 362/97.4

(58) Field of Classification Search
CPC ..... F21V 13/00; G09F 23/0058
USPC ..... 362/311.01, 311.02, 311.14, 235, 362/971.1, 97.4
See application file for complete search history.

(56) References Cited

U.S. PATENT DOCUMENTS

| | | | | |
|---|---|---|---|---|
| 6,871,979 | B2 * | 3/2005 | Mai | 362/241 |
| 7,207,709 | B2 * | 4/2007 | Chuang et al. | 362/633 |
| 7,275,842 | B2 * | 10/2007 | Wang et al. | 362/373 |
| 7,621,666 | B2 * | 11/2009 | Han | 362/633 |
| 8,136,960 | B2 * | 3/2012 | Wu | 362/235 |
| 8,616,737 | B2 * | 12/2013 | Lim et al. | 362/373 |
| 2011/0309668 | A1 | 12/2011 | Efthymiou et al. | |
| 2013/0070541 | A1 | 3/2013 | Chung | |

FOREIGN PATENT DOCUMENTS

| | | | |
|---|---|---|---|
| DE | 20118243 | U1 | 1/2002 |
| DE | 20314391 | | 1/2004 |
| DE | 202010014361 | U1 | 2/2011 |
| EP | 2068192 | A1 | 6/2009 |
| FR | 2955400 | | 7/2011 |
| WO | WO2012/076412 | | 6/2012 |

OTHER PUBLICATIONS

European Search Report dated Apr. 25, 2014 in European Application No. 12185401.2.

* cited by examiner

*Primary Examiner* — Ali Alavi
(74) *Attorney, Agent, or Firm* — Hope Baldauff, LLC

(57) ABSTRACT

A display apparatus for an electric hob may have a colored, such as reddish-brown, hob plate, which may be composed of glass ceramic and have an inhomogeneous transmission profile for light with high transmission in the region of wavelengths of greater than 700 nm and with low transmission in the region below 700 nm. The display apparatus may have one light source with a defined output spectrum. The color locus of the light source may be shifted to the left starting from white and have a blue tinge. This configuration may provide a display that is visible or that correspondingly lights up as a substantially white illuminated display through the colored cover.

24 Claims, 5 Drawing Sheets

DISPLAY APPARATUS, ELECTRICAL APPLIANCE AND DISPLAY METHOD

CROSS REFERENCE TO RELATED APPLICATIONS

This application claims the benefit of German patent application DE 10 2011 114 741.5, filed on Sep. 28, 2011, the contents of which are incorporated by reference for all that it teaches.

FIELD

The invention relates to a display apparatus for an electrical appliance having a cover, wherein the cover is colored or chromatic and has an inhomogeneous transmission profile for light. The invention also relates to an electrical appliance having a display apparatus of this kind, and to a method for driving a display apparatus of this kind.

BACKGROUND

In electrical appliances having a cover over a display apparatus, for example with light sources such as LEDs, the color of a visible display depends significantly on the color or the transmission of the cover. On account of this, the color of a display can be colored or else a desired color may be achieved only to a limited extent, depending on the transmission profile of the cover and the color of the light source.

By way of example, hobs as an electrical appliance with a hob plate which is composed of glass ceramic as a cover have a transmission profile for light which is inhomogeneous and has a high transmission in the region of wavelengths of greater than 700 nm. The transmission in the region of wavelengths of less than 700 nm is very low and sometimes lies below 1% or even is 0%. The reason for this can be found in the material properties of glass ceramic which are optimized for suitable use in electric hobs with requirements for stability on the one hand and for transmission in the wavelength region of radiant heating bodies which is as high as possible on the other hand, and even produce the abovementioned low transmission at low wavelengths. Therefore, colors with a low wavelength, that is to say in the yellow, green and blue regions, cannot be displayed or can be only marginally displayed with a display apparatus of the customary design in the case of a described cover.

WO 2012/076412 A1 discloses a display apparatus in which a relatively large color bandwidth can be created for a display, in particular also for a white display, with three primary-color LED lamps by appropriate mixing. However, firstly, this is considered to be relatively costly. Secondly, a combination of three interacting light-emitting diodes cannot be provided for every display that can be used in practice. By way of example, this is not practical in so-called seven-segment displays with an overall height of usually less than 2 cm.

SUMMARY

The disclosure herein is based on the problem of providing a display apparatus of the kind mentioned in the introductory part, an electrical appliance which is provided with the said display apparatus, and a method for operating a display apparatus of this kind, with which display apparatus, electrical appliance and method problems in the prior art can be avoided and a display that appears white can be achieved, in particular in the case of covers having different levels of translucence, and potentially with a reddish-brown color.

According to one aspect of the disclosure, a display apparatus for an electrical appliance may include a cover and two light sources. The cover may include a color and an inhomogeneous transmission profile for light with high transmission in a region of wavelengths of greater than 700 nm and with low transmission in a region of wavelengths of less than 700 nm. A first light source may include a defined output spectrum for emitting white light through the cover. A second light source may include a color or a color locus that when the first light source and the second light source emit light through the cover, the display is visible as a display emitting white light. The color locus of the second light source may lie to the left of a color locus of the first light source.

These and further features can be gathered from the claims as well as from the description and the drawings, wherein the individual features can each be implemented in their own right or in groups in the form of sub-combinations in the case of an embodiment of the disclosure and in other fields, and may represent advantageous and inherently patentable embodiments for which protection is claimed here. The subdivision of the application into individual sections and subheadings do not restrict the general validity of the statements made therein.

BRIEF DESCRIPTION OF THE DRAWINGS

Exemplary embodiments of the disclosure are schematically illustrated in the drawings and will be explained in greater detail in the text that follows. In the drawings.

DETAILED DESCRIPTION

Figure 1:
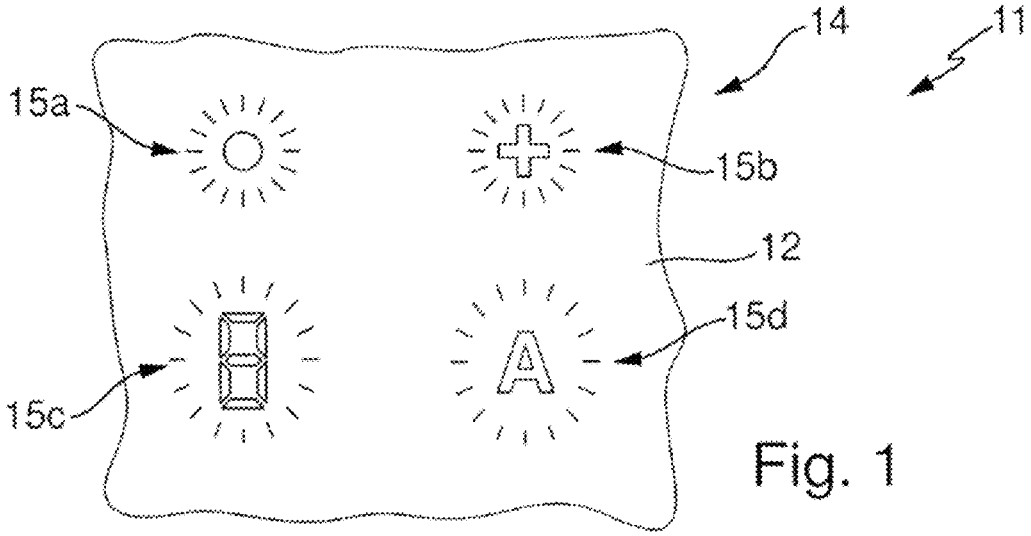
FIG. 1 shows a plan view of an electric hob as the electrical appliance with a cover and four displays beneath the said cover which shine light through the cover.

As discussed above, the disclosure herein is based on the problem of providing a display apparatus of the kind mentioned in the introductory part, an electrical appliance which is provided with the said display apparatus, and a method for operating a display apparatus of this kind, with which display apparatus, electrical appliance and method problems in the prior art can be avoided and a display that appears white can be achieved, in particular in the case of covers having different levels of translucence, and potentially with a reddish-brown color.

This problem may be solved utilizing the apparatus and methods described below. Advantageous and preferred refinements of the disclosure are specified in the further claims and will be explained in greater detail in the text that follows. Some of the following features are described only for the display apparatus, the electrical appliance or the method. However, irrespective of this, they are intended to be applicable to the display apparatus, the electrical appliance and the method. The wording of the claims is included in the content of the description by express reference.

According to various embodiments, the cover may have an inhomogeneous transmission profile for light with a high transmission in the region of wavelengths of greater than 700 nm. In the region of wavelengths of less than 700 nm, the transmission is lower and can drop down to a maximum of a few per cent at considerably less than 700 nm. The display apparatus has, for a single display, that is to say for a single display location or an illuminated point or an illuminated symbol, which is usually also displayed by a single light source, at least one light source with a defined output spectrum for emitting light through the cover of the electrical appliance. In the case of an electrical appliance in the form of the said electric hob with a hob plate, the display apparatus or the light source even emits light through this hob plate as a cover.

In a first aspect of the disclosure, the one light source emits white light. In this case, the said light source, as a CIE color locus, can have the coordinates (x; y) of (0.3; 0.3) or a similar color locus, for example also (x; y)=(0.33; 0.33). A further light source is provided in addition and in the physical vicinity of the said one light source, in particular as close as structurally possible next to the said one light source. This second light source has such a color or such a color locus that, when the two light sources emit light through the cover of the electrical appliance jointly with a matching intensity, a white illuminated display is visible or is perceived by a viewer as the display in respect of perception by the human eye. In this case, the color locus of this second light source lies to the left of the color locus of the first white light source, that is to say has a lower value for (x). Therefore, with a somewhat increased level of expenditure in the form of the second light source, a light can be generated in the display apparatus that appears white or is perceived to be white after passing through the cover with the abovementioned transmission profile.

In this case, the first light source and the second light source may also advantageously be arranged as close to one another as possible, for example as close as permitted by their housings, which can advantageously be designed using SMD technology, and their electrical wiring.

In a further aspect of the disclosure, the color locus of the second light source can advantageously have a similar y-coordinate to the color locus of the white first light source. The second light source can have a somewhat smaller y-coordinate. The x-coordinate of the color locus of the second light source advantageously lies between 0.0 and 0.13. It can be, for example, approximately 0.05.

In another aspect of the disclosure, the second light source may be designed such that it emits light in a spectrally pure manner or in a very narrow band. It can advantageously have a wavelength of approximately 470 to 510 nm, particularly advantageously approximately 490 nm, that is to say appear approximately turquoise to the human eye. The combination of the light from this light source, for example in turquoise, with the white light from the first light source produces a light which substantially again appears turquoise to blue. After passing through the said reddish-brown cover, in particular a customary hob plate that is composed of glass ceramic with a reddish-brown color, the human eye perceives a display that emits white light.

In a further aspect of the disclosure, only the one single light source may be used for each display, that is to say a second light source, the light from this second light source being mixed with the first light source, is not provided directly next to the said first light source. The color locus of the said single light source is shifted to the left from white or the x-coordinate of the CIE color locus is smaller. This second light source can therefore advantageously have a blue tinge or a turquoise tinge. The light from this single light source again appears white to the human eye through the abovementioned cover, in particular that is composed of reddish-brown glass ceramic.

According to various embodiments, the color locus of this abovementioned single light source in respect of the y-coordinate is virtually the same as that of white light, that is to say lies between 0.20 and 0.28, for example at somewhat over 0.24. The x-coordinate of the color locus of this single light source is considerably further left than for white light, advantageously between 0.1 and 0.2, particularly advantageously at approximately 0.18. The light appears to have a blue tinge to the human eye. The said single light source can be designed to emit light in a wide band, in particular it emits light in the green and blue region with a significant intensity.

In some aspects of the disclosure, the said single light source can have a luminous spectrum which is standardized to 1 and which has a maximum standardized intensity of 1.0 at a wavelength of 450 nm to 470 nm. In particular, this maximum is approximately 460 nm. There can be a steep increase before the maximum, beginning at 0, for example starting from approximately 420 nm. Similarly, there can be a steep drop after the maximum to a relative temporary low, of which the standardized intensity is between 0.3 and 0.4. This can lie at a wavelength of between 480 nm and 500 nm, for example at approximately 490 nm. The relative temporary low is followed by a relative temporary high with a standardized intensity of between 0.35 and 0.45, which can be present at a wavelength of between 500 nm and 520 nm, in particular at approximately 510 nm.

After the relative temporary high, the standardized intensity drops again, specifically first steeply and then so as to terminate flatly again. In the case of this drop, the standardized intensity can lie below 0.1 starting from a wavelength of approximately 570 nm, and at below 0.01 at a wavelength starting from 700 nm. This means that this light source has a high proportion in the blue region and a temporary high in the green or turquoise region. Red light is hardly present in the spectrum.

LEDs may be advantageously generally used for the disclosed embodiments as light sources with a semiconductor crystal. The semiconductor crystals are usually treated or doped with phosphorus in order to influence the colors. For example, the light sources cited for two embodiments of the disclosure can also be formed in this way. The semiconductor crystals can therefore both be doped with phosphorus and treated or doped with further materials in order to produce the desired colors or color spectra.

A plurality of displays can be provided in a display apparatus according to the disclosure herein. For the above-described individual display, in each case only a single, color locus-corrected white light source can be provided as a symbol or light point, as is defined in one of Claims 4 to 9. In this way, individual displays of this kind can be realized with the lowest amount of expenditure possible. For a so-called seven-segment display, preferably the same color locus-corrected white light sources can be used, specifically a single light source for each illuminated segment. In this case, the entire display apparatus has one type of light source or nothing but identical light sources, and therefore there can be no color difference on account of deviations in design or aging or the like. As an alternative, it is possible to provide pure-white light sources, for example due to the construction or for cost reasons, the said pure-white light sources being shifted to a color locus according to claim 5 with a second light source. This second design can be used for seven-segment displays or advantageously for individual displays.

In a further refinement of the disclosure, it is possible for the intensities of narrowband and wideband light sources to be adjusted when a plurality of light sources are provided for a single display. As a result, other colors can be displayed apart from a white display, this significantly increasing the variety of applications and usability.

It is also possible for the abovementioned light source, which appears white after emitting light through the cover, to be combined with further light sources. These light sources are preferably light sources that emit light in a spectrally pure manner or in a narrow band, in particular green with a wavelength of between 540 nm and 550 nm, and red with a wavelength of between 600 nm and 610 nm. A display apparatus or display can be provided with the colors white, green, yellow and red and mixtures of these colors by the light source that emits white light and one green and one red light source, that is to say a total of three light sources. In the case of a narrowband luminous spectrum, the bandwidth of these light sources should not be greater than 20 nm, as far as possible should even be less than 10 nm. In this way, different mixed colors can also be achieved in the resulting RGW color space. This will be explained in greater detail below with reference to the corresponding figure.

In a method for driving the said display apparatus, the light sources can be driven by a customary control means for a display, in particular by a hob control means. The circuitry of the control means only needs to be matched to the altered flux voltage of the light sources.

The exact wavelengths or spectra of the wavelength distribution of a single light source or two light sources primarily may be matched to a cover that is used. However, these wavelengths can be precisely determined by relatively simple experiments or by calculation.

Turning now to the drawings, FIG. 1 shows a plan view of an electric hob 11 as an electrical appliance according to the disclosure that has a hob plate 12 that is composed of glass ceramic. Heating devices, which are known per se, for example radiant heating devices, induction heating devices or else contact heating devices, are provided beneath the hob plate 12. However, these are known to a person skilled in the art and therefore are not illustrated either in FIG. 1 or in FIG. 2. FIG. 1 shows a display region 14 of the hob, which display region is situated by way of example in a front region of the hob plate 12 close to a front edge of the electric hob 11, that is to say in the direction of an operator. The display region 14 has four displays 15*a* to 15*d* that differ from one another and will be explained in greater detail in the text that follows. Their light sources are advantageously LEDs and/or are mounted as SMD components on a printed circuit board 13 as the support.

Figure 2:
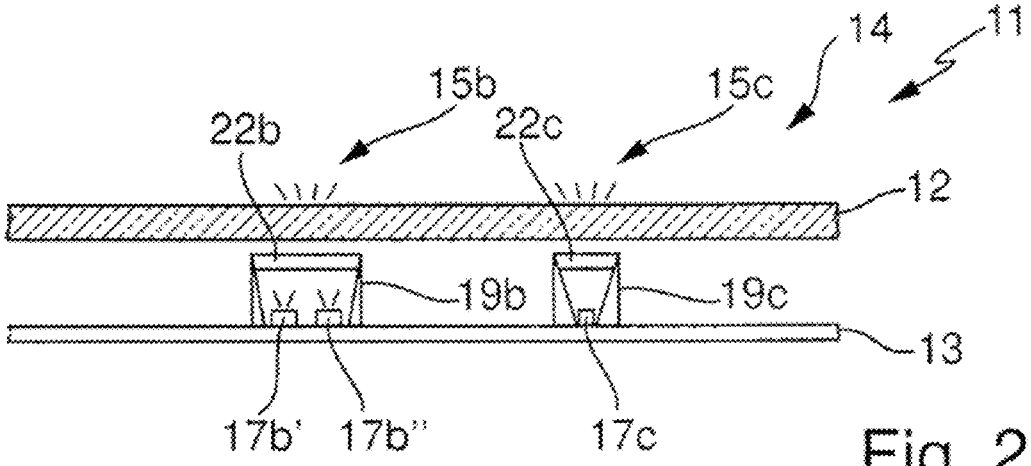
FIG. 2 shows a sectional illustration through an electric hob according to FIG. 1.

FIG. 2 shows a display 15*b* from FIG. 1 in section. The said display has an LED 17*b*' on the left of the printed circuit board 13 and an LED 17*b*" on the right next to it, said LEDS being arranged close to one another. The said LEDs can also be formed as SMD components and, in this case, be provided as close next to one as is possible in respect of assembly and electrical connection options. The LEDs 17*b*' and 17*b*" are arranged together within a screening means 19*b* or in a chamber which is formed by the said screening means. As an alternative or in addition to the screening means 19*b*, a masking means with a corresponding cutout could be provided on the lower face of the hob plate 12, the said masking means also ensuring a clearly delimited and explicitly identifiable appearance of light.

A diffusor 22*b*, for example in the form of a plate, which can be arranged firmly on or adhesively bonded to or moulded on the screening means 19*b* is located at the top of the screening means 19*b*. According to the first embodiment of the disclosure, the two LEDs 17*b*' and 17*b*" are formed in the manner described in the introductory part. This means, for example, that the LED 17*b*' emits white light with a color locus for white. The other LED 17*b*" has a color locus to the left of the said color locus for white and is formed, for example, as a light source which emits pure turquoise light with a wavelength of approximately 490 nm. The LED 17*b*' therefore emits white light in a wide band, while the LED 17*b*" emits turquoise light in a narrow band. The luminous intensities of said LEDs are adjusted by virtue of construction and driving such that the display 15*b* appears in white light even after light is emitted through the reddish-brown hob plate 12 that is composed of glass ceramic.

On account of the diffusor 22*b* which is arranged above the LEDs 17*b*' and 17*b*", the spectrum of the emitted light is not shifted and the said emitted light is not colored, but rather the appearance of the light is made more uniform. Furthermore, this results in improved mixing of the light from the two light sources. As has already been described, light is then emitted through the hob plate 12 which is composed of glass ceramic, this light being visible above the said hob plate as a pure-white display 15*b*, for example in the symbolic form of a plus sign. The two light sources in the form of LEDs 17*b*' and 17*b*" can therefore primarily be used in displays with a relatively large surface area in comparison to the size of an LED or an SMD LED or two of these can be used, since the minimum required installation space obviously depends on this added variable.

As yet a further refinement, a display 15*c* is shown on the right in FIG. 2, the said display being a so-called seven-segment display, as illustrated in FIG. 1. In this case, only a portion of the said display is shown in the section in FIG. 2, it being possible for this portion to produce or represent, for example, one of the three bars that run horizontally in FIG. 1.

A light source 17*c* is provided for the display 15*c*, the said light source again being arranged in a screening means 19*c* that can be the housing of the seven-segment display. Seven-segment displays of this kind are known, for example, from DE 20314391 U or US 2010/0309668 A, express reference hereby being made to these documents.

Therefore, the LED 17*c* is arranged in a space within the screening means 19*c* and emits light upwards through a diffusor 22*c*, which is also provided here and again functions in the manner described above.

In this case, the LED 17*c* is formed in such a way that, in accordance with the abovementioned second embodiment of the disclosure, it has a color locus which is shifted somewhat to the left starting from pure white, wherein it can have a blue tinge or turquoise tinge, as has already been described in the introductory part and will be explained in greater detail in the text which follows. This single LED 17*c* therefore emits its light through the hob plate 12, which is composed of glass ceramic, with the result that a pure-white display is visible above the said hob plate as display 15*c*, in particular as a pure-white seven-segment display. Therefore, according to the abovementioned prior art, the provision of a single LED or light source can produce a seven-segment display with a single housing, which seven-segment display allows a pure-white display in the case of a reddish-brown glass ceramic.

Figure 3:
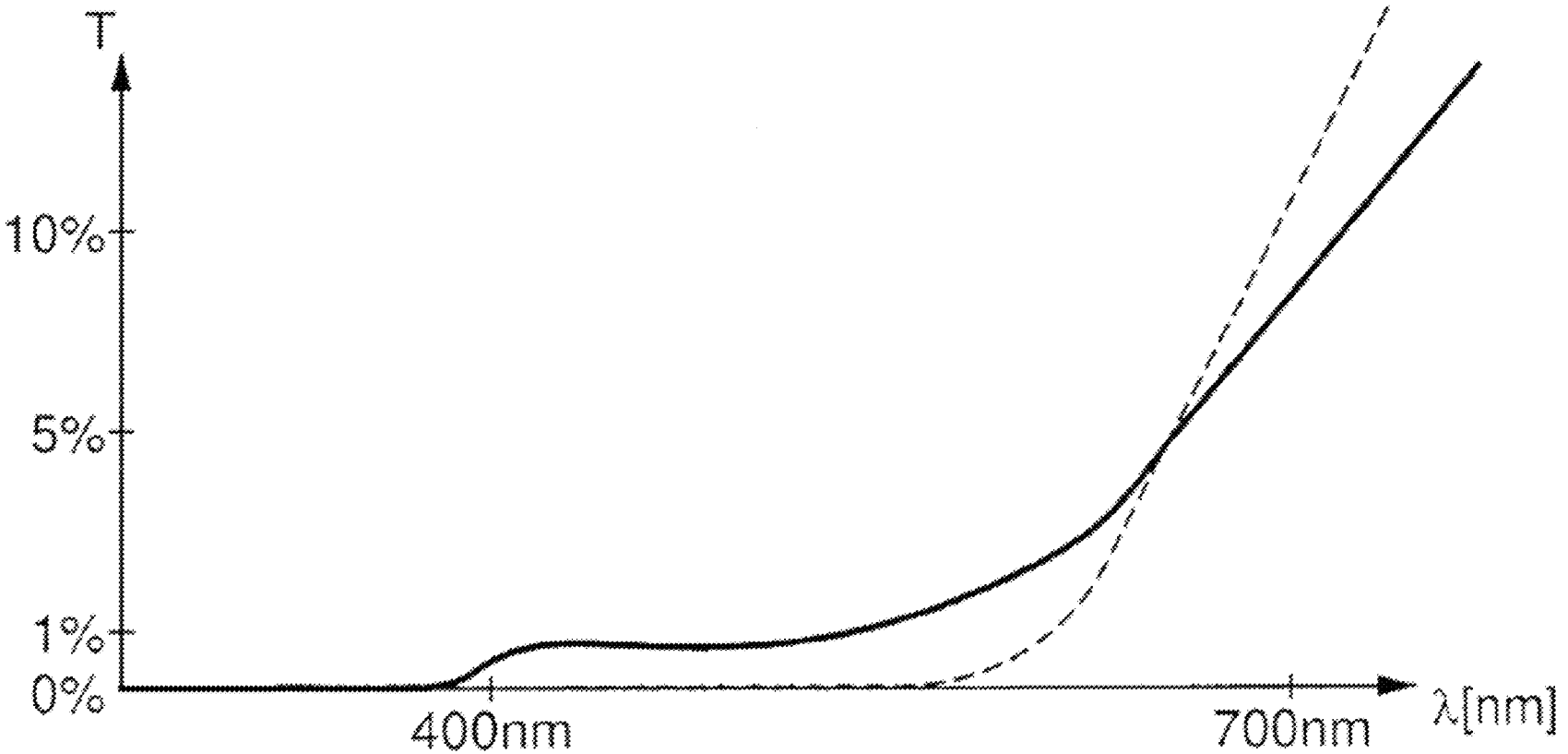
FIG. 3 shows the profile of the transmission with respect to the wavelength for various glass ceramics as covers according to FIGS. 1 and 2.

FIG. 3 shows the transmission spectrum of a glass ceramic, which has been known to date using a dashed line. It can be seen here that the transmission T rises sharply or is high for wavelengths of greater than 700 nm. This is advantageous particularly for the use of heating devices in the form of radiant heating devices, as has already been explained in the introductory part. In the case of known glass ceramics of this kind, there is absolutely no transmission at all in the region of wavelengths considerably lower than 700 nm, this light is therefore absorbed.

However, glass ceramics can also be produced which, in accordance with the profile shown using a solid line, have a low, but still present, transmission in the region considerably below 700 nm. Even a transmission of a few % or approximately 1% or even somewhat less, for example also 0.5%, is sufficient to realize an illuminated display through the glass ceramic given a corresponding illumination force of the light sources. A glass ceramic of this kind is described in WO 2012/076412 A1 and is available from Schott AG under the trade name CERAN HIGHTRANS eco.

Figure 4:
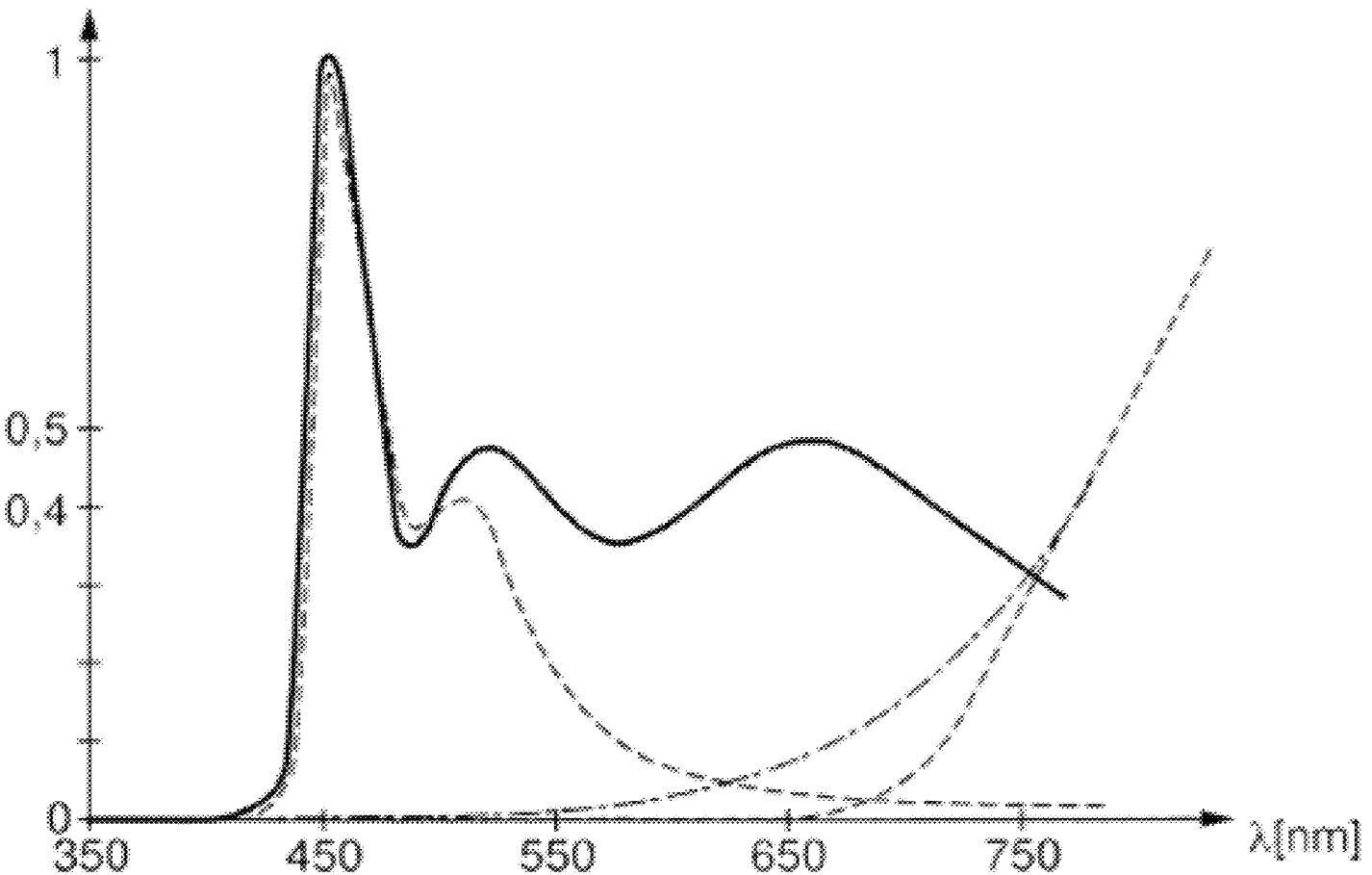
FIG. 4 shows the spectrum of a light source according to the various embodiments, the transmission spectrum of the glass ceramic and the standardized spectrum of the light which can be seen through the glass ceramic.

FIG. 4 shows the profile of various spectra. The transmission spectrum of an abovementioned glass ceramic from Schott AG is shown using a dash-dotted line. Although the transmission is low in the region of wavelengths of less than 700 nm, or very low below 550 nm, it is still present, compare FIG. 3.

A spectrum of the light source according to the disclosure in line with the second embodiment, which spectrum is standardized to 1, is shown using a dashed line. The profile exhibits a sharp rise starting from approximately 420 nm, with the steepest region at around 450 nm and a maximum at 460 nm. This is followed by a similarly sharp drop to an intensity of approximately 0.35 at approximately 490 nm. From there, the intensity again rises slightly to a value of 0.4, in order to then again drop considerably to a value of approximately 0.1 at a wavelength of 570 nm. Starting from this point, the curve then falls asymptotically rapidly towards zero in the direction of the region of relatively large wavelengths. A standardized spectrum of the light source of this kind is also given in the case of a light source cited in the introductory part after light passes through the glass ceramic, that is to say with a color locus of approximately (x; y)=(0.32; 0.32) or (0.33; 0.33) which is then visible to the human eye as white light. For glass ceramics with a different transmission spectrum, in particular with even greater transmission, the spectrum can again have a somewhat different appearance. Furthermore, the color locus can lie somewhere different, this being explained in greater detail with reference to FIG. 5, for example at approximately (x; y)=(0.25; 0.25).

FIG. 5 again shows the so-called CIE standard chromaticity diagram using x-coordinates and y-coordinates. The region of theoretical colors lies in the triangular region between 0 and 1.0 for each of the two coordinates. The line SFL is the spectral color line along which the wavelengths of the pure narrowband colors are plotted. The starting point at 330 nm and the end point at 790 nm on the right are connected by the so-called purple line PL. Furthermore, the BBL line as the black body curve is also plotted, the said black body curve indicating the color temperatures for various standardized radiators and beginning on the far right of the spectral color line SFL at 1000 K and running through a plotted value of, for example, 7500 K and as far as a point with an infinitely high temperature where it therefore ends on the left. All the points on this BBL line appear white to the human eye, and therefore, very generally, the light from the light source should lie on this BBL line or close to it after being emitted through the cover or glass ceramic. Furthermore, the RGB color space is plotted in triangular form as a large triangle and the abovementioned RGW color space is plotted as an upper relatively small triangle.

A pure-white light source which is shown in FIG. 2 has a color locus like that plotted as 17*b*'. This color locus lies on the BBL line at approximately (x; y)=(0.3; 0.3). The LED 17*c* according to FIG. 2 lies on the color locus approximately in the position (x; y)=(0.13; 0.31). Although the light from the said LED with this wavelength or with this spectrum or color locus appears per se as light turquoise/blue/green to the human eye, after light is emitted through the reddish-brown glass ceramic with the transmission spectrum in accordance with FIG. 4, a user sees a white light in accordance with the color locus 17*b*'.

The light source 17*b*' from FIG. 2 is in the form of a pure-white light source with the color locus 17*b*'. The second light source 17*b*" lies on a color locus 17*b*" on the spectral color line SFL at a wavelength of approximately 490 nm and is similarly plotted. As already described above, the light is a light source which emits light in a very narrow band or emits spectrally pure light with the wavelength of approximately 490 nm and virtually no radiation above or below this.

Furthermore, the color locus 18 also shows the light appearance which the human eye perceives when only a pure-white light source in accordance with the color locus 17*b*' emits light through a reddish-brown glass ceramic. The hue produced in this case is light red or pink.

It goes without saying that other colors or color loci of a display which is to be seen by the human eye can also be achieved in accordance with the considerations presented here, depending on the transmission behaviour of the glass ceramic. Furthermore, it goes without saying that the disclosure can also be used in other electrical appliances apart from electric hobs with hob plates, which are composed, of glass ceramic. Examples include other electrical appliances, the covers of the said electrical appliances, beneath which covers an illuminated display is arranged, wherein the illuminated display is intended to be visible above the cover, being produced or constructed according to the disclosure. In addition to baking ovens or other cooking devices as kitchen appliances, examples include entertainment electronics appliances and also, on account of the stable mechanical properties of glass-ceramic covers, electrical appliances in publically accessible areas such as automatic ticket machines or the like.

The color locus for the sought individual light source can be calculated as follows: it is necessary to take into account that the perceptions of the eye for the colors or the RGB colors are different. These are determined empirically and shown in the diagram in FIG. 5. To this end, the so-called CIE standard observer is provided. The intensity can be recorded from the standardized spectrum of the intensity, which is shown using a solid line, according to FIG. 4, for example, for each wavelength $\lambda$ and be multiplied by the intensity of each individual one of the individual RGB spectra, as perceived by the human eye in accordance with FIG. 6, at exactly this wavelength $\lambda$. The three tristimulus curves in FIG. 6 show the human perception for BLUE using the solid line, the perception for GREEN using the dash-dotted line, and the perception for RED using the dashed line.

These values from the multiplication are then added up for all wavelengths $\lambda$, and this then gives the values for the three individual colors of the RGB spectrum. If, in this case, the simplified procedure of this being done for 1 nm steps in each case is followed, a summation is obtained. Theoretically, it is integration of the three colors over all the wavelengths, but this is extremely difficult to calculate.

Figure 6:
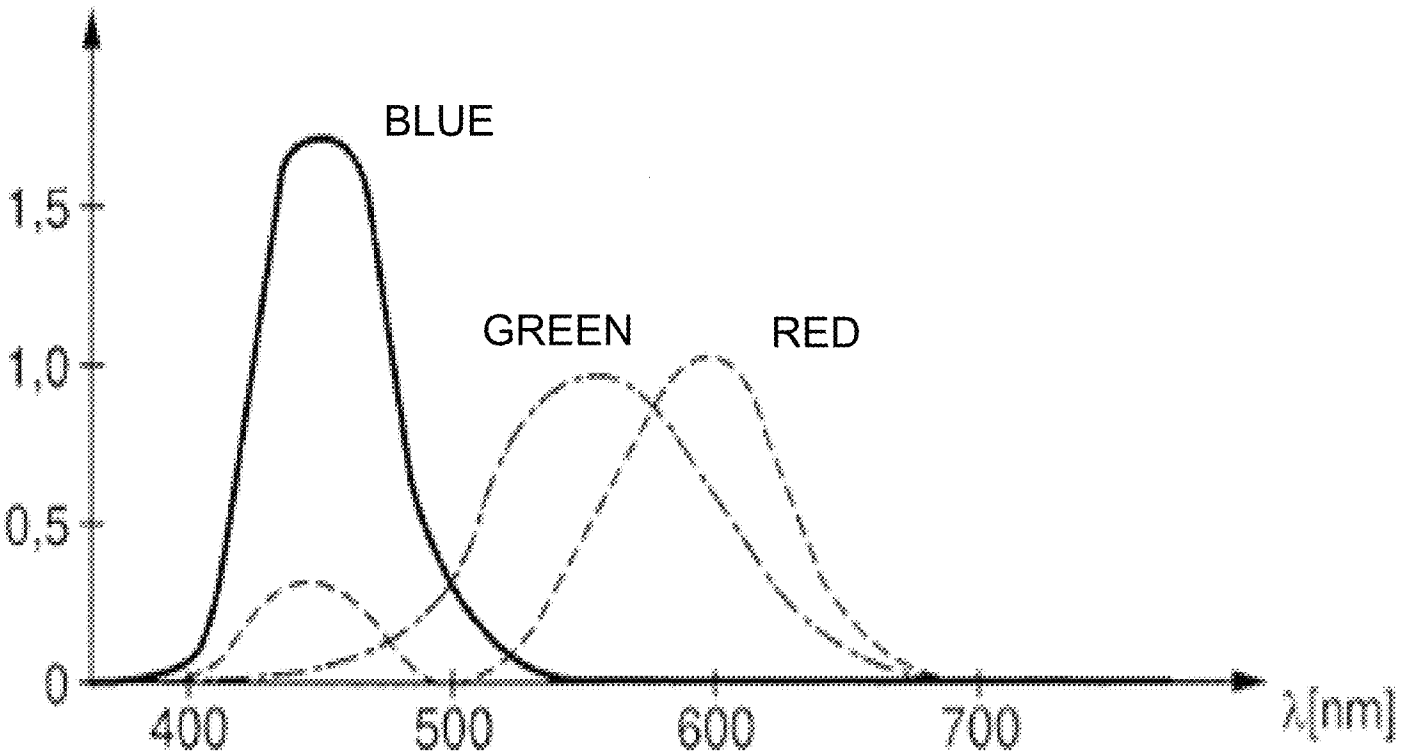
FIG. 6 shows the three tristimulus curves of human perception for the three primary colors.

The result of the summation can in turn be used in the known three-dimensional RGB color space to determine the required colors which have to be possessed by the light source or LED which appears white to the human eye with the perceptions according got FIG. 6 after light is emitted through the glass ceramic.

Figure 5:
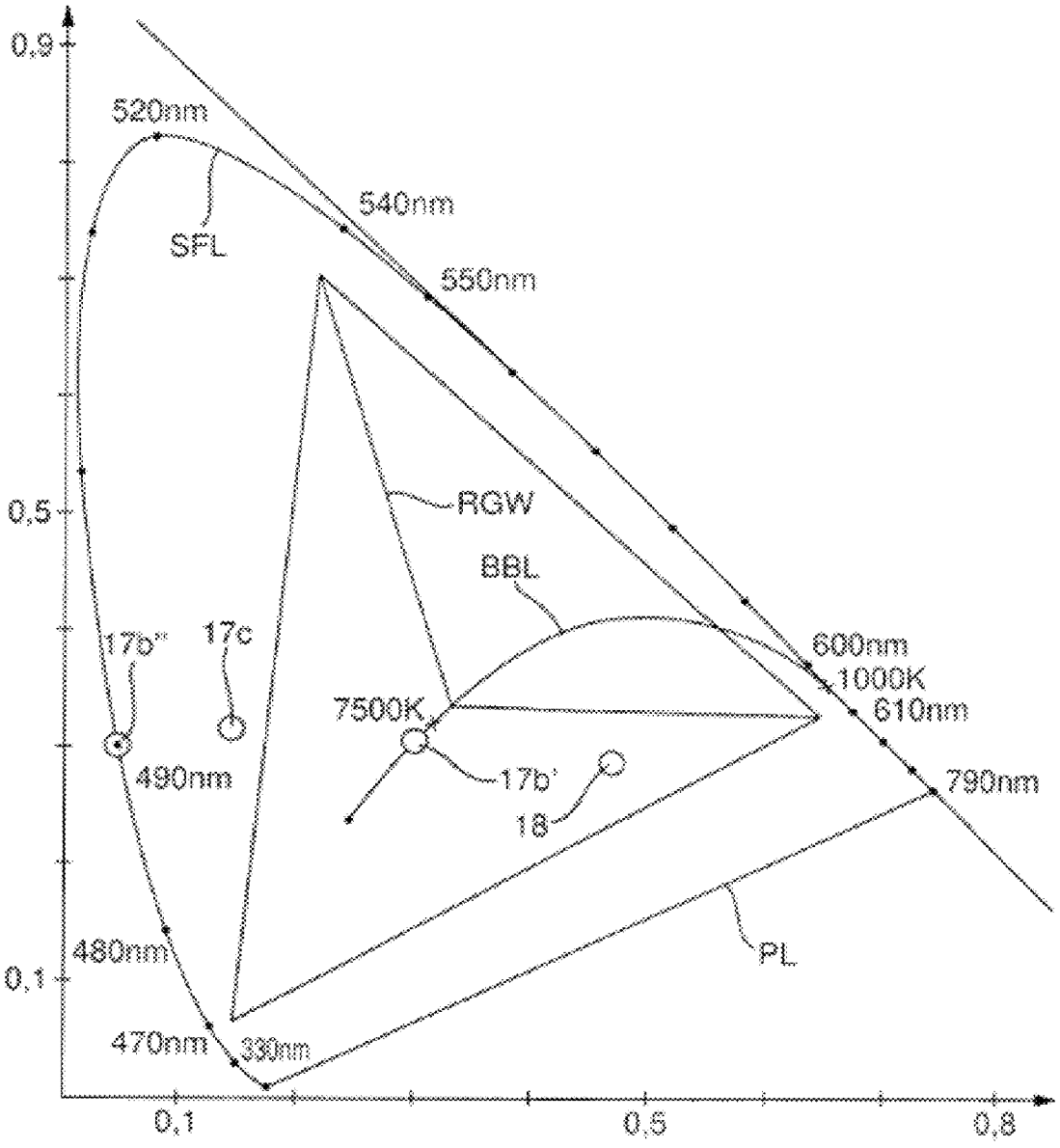
FIG. 5 shows an illustration of the CIE standard chromaticity diagram with plotted profiles and the plotted color loci for various light sources or filters.

Standardization for the CIE chromaticity diagram according to FIG. 5 can take place in such a way that the values for the x-coordinate and the y-coordinate are obtained by adding up the values for the three colors in accordance with the previous calculation, and for the x-coordinates, that is to say the color red, the reciprocal of the result of the adding-up process is multiplied by the value for RED, and for the y-coordinate, that is to say the color green, the reciprocal of the result of the adding-up process is multiplied by the value for GREEN. The value for the color blue is then obtained by subtracting the values for the color red and for the color green from 1.

The invention claimed is:

1. A display apparatus for an electrical appliance, comprising:

a cover comprising a color and an inhomogeneous transmission profile for light with high transmission in a region of wavelengths of greater than 700 nm and with low transmission in a region of wavelengths of less than 700 nm;

a first light source comprising a defined output spectrum for emitting light through said cover, wherein said first light source is configured to emit white light;

a second light source comprising a color or a color locus that when the first light source and the second light source emit light through said cover, said display is visible as a display emitting white light, wherein the color locus of said second light source lies to a left of a color locus of said first light source.

2. The display apparatus of claim 1, wherein said first light source emits said white light with said color locus (x; y) of (0.3; 0.3).

3. The display apparatus of claim 1, wherein said second light source is in physical vicinity of said at least one light source emitting white light.

4. The display apparatus of claim 1, wherein said color locus of said second light source has virtually said same y-coordinate as that of said first white light source.

5. The display apparatus of claim 4, wherein said x-coordinate of said color locus of said second light source lies between 0.0 and 0.1.

6. The display apparatus of claim 1, wherein said second light source is configured such that it emits light spectrally in a very narrow band or emits light purely.

7. The display apparatus of claim 6, wherein said second light source has a wavelength of 470 nm to 510 nm.

8. A display apparatus for an electrical appliance, comprising:

a cover comprising a color and an inhomogeneous transmission profile for light with high transmission in a region of wavelengths of greater than 700 nm and with low transmission in a region of wavelengths of less than 700 nm; and a light source comprising a defined output spectrum for emitting light through said cover, wherein the light source comprises a single light source for each display, without a second light source directly adjacent to the light source, and wherein a color locus of said light source is shifted to a left from white.

9. The display apparatus of claim 8, wherein said cover comprises a reddish-brown color and wherein said light source comprises a blue tinge, such that, through the cover, said display is visible or lights up as a display substantially emitting white light.

10. The display apparatus of claim 8, wherein said color locus of said light source comprises substantially a same y-coordinate as white light of between 0.28 and 0.35, wherein a x-coordinate of said color locus lies between 0.1 and 0.2.

11. The display apparatus of claim 8, wherein said light source is of wideband design or emits light in a wide band.

12. The display apparatus of claim 8, wherein said light source comprises a spectrum which is standardized to 1 and has a maximum standardized intensity of 1.0 at a wavelength of 450 nm to 470 nm with a steep increase before the maximum standardized intensity, beginning at zero, and a steep drop after the maximum standardized intensity to a relative temporary low with a standardized intensity of between 0.3 and 0.4 at a wavelength of between 480 nm and 500 nm.

13. The display apparatus of claim 12, wherein the relative temporary low is followed by a relative temporary high with a standardized intensity of between 0.35 and 0.45 at a wavelength of between 500 nm and 520 nm.

14. The display apparatus of claim 12, wherein from said steep drop, said standardized intensity again drops to below 0.1 starting from a wavelength of approximately 570 nm.

15. The display apparatus of claim 12, wherein said standardized intensity again drops with an asymptotic approximation to zero.

16. The display apparatus of claim 8, wherein said light source comprises a semiconductor crystal that is doped with phosphorus in such a way that a desired color is achieved.

17. The display apparatus of claim 8, wherein a plurality of said displays are provided in said display apparatus, wherein, for all said displays, in each case a single, color locus-corrected white light source is provided as a symbol, light point or segments of a seven-segment display as said display.

18. The display apparatus of claim 8, wherein light sources with a color locus from said RGW color space are provided, wherein said intensities of said light sources are adjustable between a minimum value and a maximum value for displaying further colors.

19. The display apparatus of claim 18, wherein a light source which appears white after light is emitted through said cover, is combined with further light sources, each of which emits light in a spectrally pure manner or in a narrow band.

20. The display apparatus of claim 19, wherein said further light sources emit light in a spectrally pure manner or in a narrow band green with a wavelength of between 540 nm and 550 nm and red with a wavelength of between 600 nm and 610 nm, for a display with the colors comprising white, green, yellow or red.

21. An electrical appliance, comprising:

a display apparatus comprising a cover comprising a reddish-brown color and an inhomogeneous transmission profile for light with high transmission in a region of wavelengths of greater than 700 nm and with low transmission in a region of wavelengths of less than 700 nm, wherein the cover is translucent;

a first light source comprising a defined output spectrum for emitting light through said cover, wherein said first light source is configured to emit white light;

a second light source comprising a color or a color locus that when the first light source and the second light source emit light through said cover, said display is visible as a display emitting white light, wherein the color locus of said second light source lies to a left of a color locus of said first light source.

22. The electrical appliance of claim 21, wherein said electrical appliance comprises an electric hob and said cover comprises a hob plate composed of glass ceramic.

23. The electrical appliance of claim 21, wherein said transmission through said cover in a region of wavelengths of less than 700 nm is less than 5%.

24. A method for driving a display apparatus, comprising:

emitting white light having a substantially blue tinge from a plurality of wideband light sources of a display apparatus through a cover, wherein the cover comprises a color and an inhomogeneous transmission profile for light with high transmission in a region of wavelengths of greater than 700 nm and with low transmission in a region of wavelengths of less than 700 nm;

emitting light from a plurality of second light sources comprising a color or a color locus to a left of a color locus of said wideband light sources such that when combined with the white light, said display is visible as a display emitting white light, wherein the color locus of said second light source lies to a left of a color locus of said first light source.

* * * * *